United States Patent [19]

Evon

[11] 4,392,674

[45] Jul. 12, 1983

[54] ICE SKATE SCABBARD

[76] Inventor: Marc A. Evon, 4070 Kennedy Dr. E., Windsor, Ontario, Canada, N9G 1X8

[21] Appl. No.: 245,398

[22] Filed: Mar. 19, 1981

Related U.S. Application Data

[63] Continuation-in-part of Ser. No. 89,542, Oct. 29, 1979, abandoned.

[30] Foreign Application Priority Data

Apr. 2, 1979 [CA] Canada ..... 324614

[51] Int. Cl.[3] ..... A63C 3/12

[52] U.S. Cl. ..... 280/825

[58] Field of Search ..... 280/825

[56] References Cited

U.S. PATENT DOCUMENTS

| | | | |
|---|---|---|---|
| 2,238,084 | 4/1941 | Tuell et al. | 280/825 |
| 2,828,967 | 4/1958 | Vassanelli | 280/825 |
| 3,015,492 | 1/1962 | Kesner et al. | 280/825 |
| 3,135,526 | 6/1964 | Johns | 280/825 |

FOREIGN PATENT DOCUMENTS

| | | | |
|---|---|---|---|
| 152976 | 1/1956 | Sweden | 280/825 |
| 349910 | 12/1960 | Switzerland | 280/825 |

*Primary Examiner*—David M. Mitchell
*Assistant Examiner*—Joseph G. McCarthy
*Attorney, Agent, or Firm*—Eric P. Schellin

[57] ABSTRACT

An ice skate scabbard has two generally identical halves with spring means for urging the two halves together by exerting a force generally along the runner of the skate. The two halves are each molded from a suitable plastic or rubber material. In order to maintain alignment between the two halves, a slide tongue protrudes from one half and is received in a correspondingly shaped passage in the other half. Accordingly, the two halves are maintained in alignment prior to, during and after securement of the scabbard to the blade. When the scabbard is applied, the aligning tongue extends along the edge of the skate runner thus providing protection for the runner edge extending between the two halves. Each of the two halves has a dual slot: one of a relatively large radius, generally adapted to fit the column of the new type of "TUUK" (trademark) blades, while a relatively small slot is provided in the bottom of the former to house the runner of the skate. Drainage openings are provided in the bottom of the runner receiving slot to allow for natural flow of molten ice of the like from the skate runner area, with the scabbard on.

The scabbard improves the protection of the skate while improving the convenience of attaching or removing same to or from the blade. The scabbard is suitable for virtually any kind of blades, from figure skate blades to the most recent models of hockey blades.

8 Claims, 9 Drawing Figures

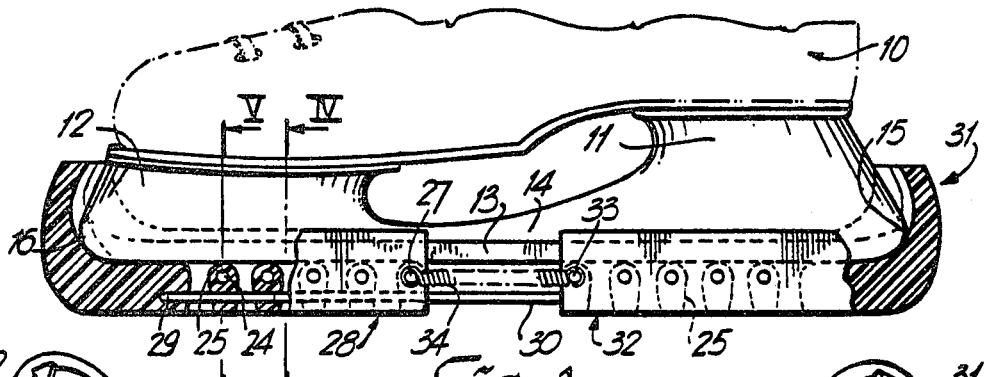
Fig-1-
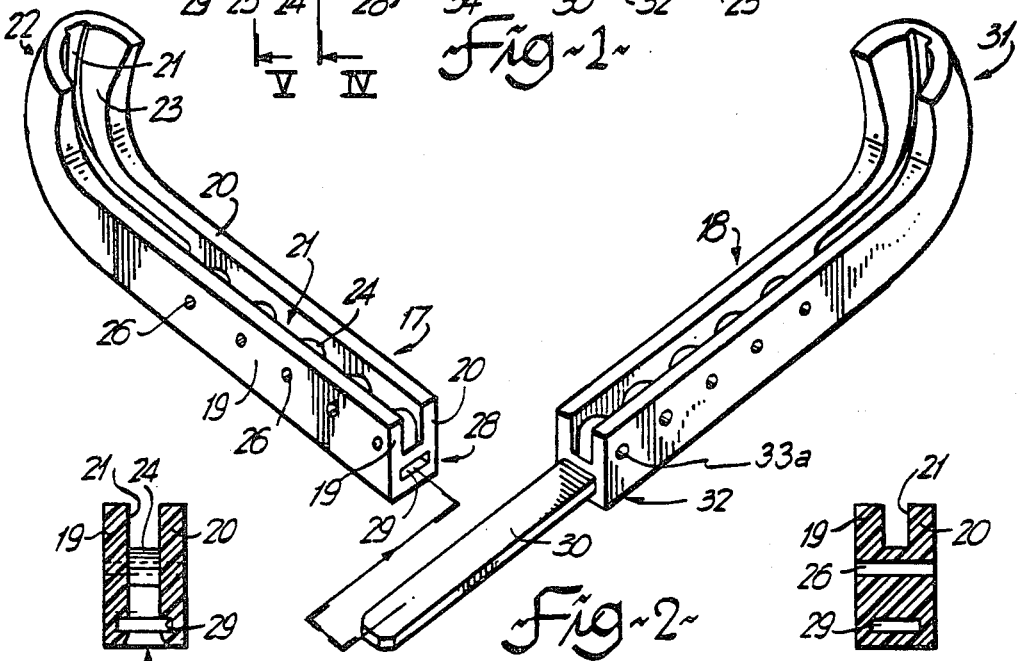
Fig-2-
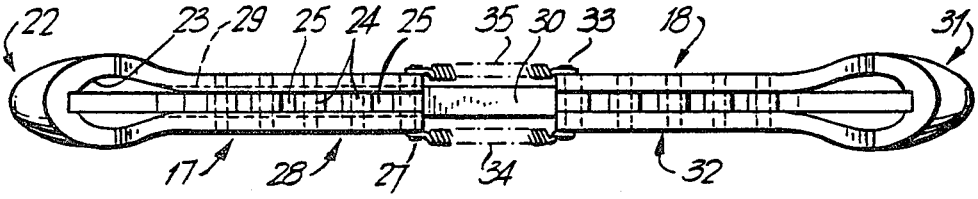
Fig-4-
Fig-5-
Fig-3-

ICE SKATE SCABBARD

This is a continuation-in-part application of my patent application Ser. No. 089,542 filed Oct. 29, 1979, now abandoned.

The present invention relates to ice skate scabbards. Ice skate scabbards of guards are used for temporary protection of ice skate runners, particularly for a period of walking relatively short distances over a concrete or the like floor with the skates on.

Many different types of ice skate scabbards are known from patent literature, some of them having long been known on the market.

In general terms, the scabbards are usually made from a relatively soft material such as rubber, nylon or the like, to avoid damage to the sharp edge of a skate runner. A scabbard usually has a runner portion provided with a slot which is arranged to fit over the skate runner. The scabbard is further provided with suitable means for removable securement to a blade. Another recognized feature of a scabbard is that its length should preferably be adjustable such that a single product can be relatively easily adjusted for use with a blade that is smaller than the originally produced scabbard.

One of the major considerations in designing a useful and commercially feasible scabbard is, besides reasonably low manufacturing costs, the convenience of attachment to a blade and detachment from a blade. Considering particularly the aspect of securement to a blade, the known scabbards can be divided into two general groups. The first group, whose typical examples are disclosed in U.S. Pat. No. 1,686,667 issued Oct. 9, 1928 to H. H. Kaske, or Canadian Pat. No. 686,823 issued S. K. Johns on May 19, 1964, has a front or toe portion adapted to fit over the tip of a skate, while the securement at the heel or back portion is accomplished by a tension spring secured to both sides of the scabbard and adapted to be placed over the top section of the rear portion of the runner, until it engages the back post of the skate blade. Thus, in use, the tension spring is stretched and extends backwardly and upwardly relative to the blade, to hold the entire assembly in place. Some of these known models of the scabbards (for instance the one described in U.S. Pat. No. 3,583,720 issued on June 8, 1971) are particularly adapted to facilitate the cutting off of the rear end of the scabbard so that the overall length of the scabbard which is normally produced in excess of the desired maximum, can be shortened to match a particular length of the runner.

The drawback of the above type of scabbards is in relatively cumbersome handling when the scabbard is being attached to or detached from a blade.

When attaching the scabbard to the blade, the tension spring, which extends across a rear portion of the runner receiving groove, has to be manipulated such as to facilitate the placement of the runner into the groove. Similarly, the removal from the skate is inconvenient as the user has to manipulate the tension spring engaging the back post of the blade.

It is therefore believed that the second group of known scabbards which utilizes resilient forces directed generally along the extension of the runner and having "pockets" both in front and in the back for engagement with the front and the back of the runner, is more convenient in use. One example of the second group of the scabbard can be found in U.S. Pat. No. 1,930,810 issued to C. I. Johnson on Oct. 17, 1933. This reference discloses a soft, stretchable skate runner guard which is made entirely in one piece and has a slot or curve to receive a runner. The ends of the guard are provided with enlargements to facilitate the grasping of the guard and to close the ends such as to fit over the runner. The disadvantage of this guard is particularly in that one single product can only be matched with a limited number of different sizes of runners. The second disadvantage is that the guard must have inherent resiliency which, in turn, results in relative softness of the guard. Accordingly, the guard is susceptible to damage by the sharp edge of the runner. Another embodiment of a guard of this type is found in German Pat. No. 740,567 issued Oct. 23, 1943 to E. Rath. This device has generally three portions adapted to engage the front of the runner, the back thereof and a central portion of same, respectively, while the intermediate sections of the runner are protected by a stretchable rubber band shaped such as to cover the runner edge of the skate. Due to relatively heavy front and rear portions and a relatively light and flexible intermediate portion, the guard is cumbersome to manipulate, particularly when the guard is being attached to the skate. A still further known scabbard of this type is disclosed in Canadian Pat. No. 661,924 issued Apr. 23, 1963 to R. M. Kesner et al. This scabbard is generally of the same structure as the one disclosed in the aforesaid German patent with the exception that the two halves are virtually identical. Instead of the resilient, stretchable rubber bands between the two halves, Kesner et al proposes a pair of springs. The drawback of the Kesner arrangement, however, is in that a substantial portion of the skate edge between the two halves remains exposed and this is not protected against mechanical damage. The width of the slot in each of the halves is adapted to fit a particular kind of skate, in the embodiment shown, a figure skating blade. The cross-sectional configuration of the slot receiving the blade is generally uniform and thus is not suitable for different kinds of blades, for instance for selective application to a figure skating blade or hockey blade. When not in use, the two halves are not maintained in aligned relationship which is of disadvantage when the scabbard is being applied as two hands are usually required to secure the scabbard to the blade, one holding the toe portion against the blade and the other manipulating the rear or toe section of same. The convenience of the aligned hold of scabbard end portions has been appreciated in Swedish Pat. No. 152,976 (Lund) showing two end portions of which one has a protrusion slidable in a longitudinal guide recess provided in the other end portion. To the other end face of the protrusion is secured one end of a tension spring. The opposite end of the tension spring is secured to an anchor bolt mounted in the recessed end portion, so that the spring is housed within the recess and urges the two end portions together, while the two halves are maintained in an aligned state. The Lund scabbard therefore is convenient to apply. On the other hand, the arrangement is relatively complex as two distinct end portions have to be moulded not to mention the complexity of proper securement of the tension spring. Thus, the Lund patent, while proposing an arrangement which is convenient to apply, does not meet the requirement of low production costs which is probably one of the reasons why the scabbard did not find a significant acceptance on the market even though it has issued more than twenty years ago. Also, the mounting of the spring at the end of the sliding protrusion necessitates a relatively solid anchor between the protrusion and its half, which, in turn dictates a relatively large cross-section of the protrusion.

It is an object of the present invention to provide a further improvement in the art of the latter group of scabbards. In particular, it is an object of the present invention to provide a scabbard of the above type which would provide, on the one hand, relatively low production costs while improving the feature of alignment.

In general terms, the present invention provides in one aspect thereof an ice skate scabbard comprising two generally identical halves arranged for engaging respective ends of an ice skate blade to provide protective cover of both said ends of the blade and of a substantial portion of the runner part thereof; spring means including a pair of tension springs each mounted at one side of the scabbard exteriorly thereof for resiliently urging said two halves to each other, each of said halves comprising longitudinal, normally horizontal channel means for receiving said runner part, each respective channel means merging at a first end of the respective half with an upwardly turned first end portion, the second end portion of each half being generally straight and having a step-on outer surface, and including means for securing the respective end of each of said tension springs to the respective second end portion, and sliding guide means for maintaining the respective second end portions in an aligned position while allowing relative movement therebetween in longitudinal direction.

In another embodiment, and still referring to the invention in general terms, an ice skate scabbard is provided which comprises, in combination: two generally identical halves arranged for engaging respective ends of an ice skate blade to provide protective cover of both said ends and of a substantial portion of the runner part thereof; each of said halves comprising longitudinal, normally horizontal channel means for receiving said runner part, each respective channel means merging at a first end of the respective half with an upwardly turned first end portion the second end portion of each half being generally straight, each second end portion having a step-on outer surface and two exterior side walls, and a face wall facing away from the respective first end and adapted to abut against the face wall of the other half, each side wall having an elongate groove-like depression extending generally parallel with said step-on surface; a pair of generally identical tension springs, each anchored at a first anchor point, to one of said halves, and, at a second anchor point, to the other one of said halves; said anchor points being each generally coincident with the respective groove-like depression, and being spaced from the respective face wall; said springs being each coextensive with and received in the respective groove-like depressions of the two halves at the respective sides of the scabbard; said springs being under tension when said face walls abut each other, whereby the face walls abutting against each other, the grooves, and the springs co-operate to maintain alignment of the two halves.

The last mentioned embodiment preferably includes an elongated pin disposed within each of said tension springs, the length of each pin being in excess of the distance between each respective anchor point and the respective face wall, whereby the pin bridges, on abutment of said face walls, a joinder of the two halves at the face walls.

The embodiment described in the two preceding paragraphs is particularly advantageous since it combines extremely low manufacturing costs with the feature of alignment of the two halves while the two halves are dissociated from the ice skate. If desired, the scabbard can even be folded generally in the fashion shown in U.S. Pat. No. 3,015,492 (Kesner et al) referred to above.

The invention will now be described in greater detail with reference to the accompanying drawings.

In the drawings:

FIG. 1 is a side view, partly in section, of a scabbard according to the invention, applied to a skate blade;

FIG. 2 is a perspective view of two halves forming the scabbard, with spring means holding the halves together not being shown for the sake of clarity;

FIG. 3 is a plan view of FIG. 1 with the skate omitted;

FIG. 4 is section IV—IV of FIG. 1; and

FIG. 5 is section V—V of FIG. 1.

Figure 6:
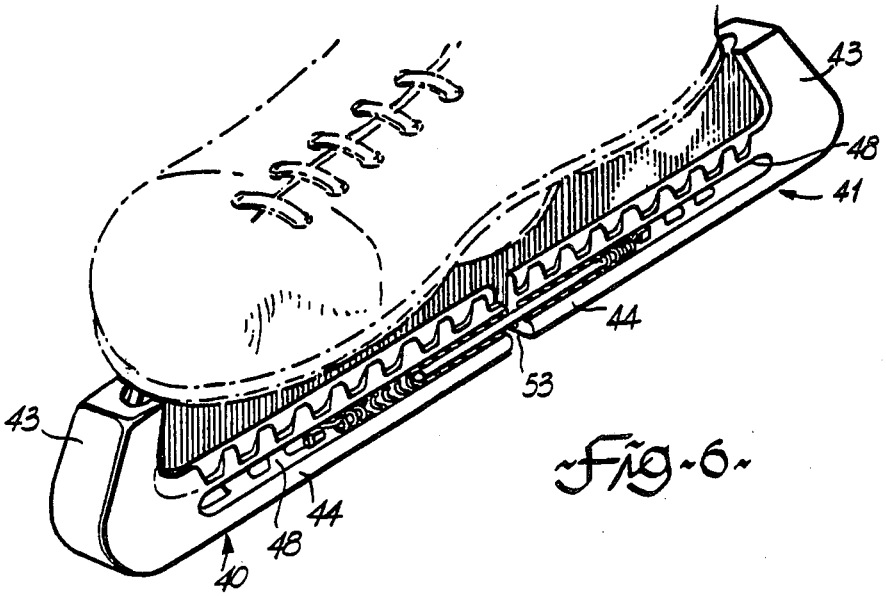
FIG. 6 is a perspective view of a second, particulary preferred embodiment of the invention, showing the scabbard as applied to a skate.

Turning now to the above drawings and in particular to FIG. 1, reference numeral 10 denotes a boot with a blade recently introduced on the market as TUUK (Trademark) blade. In general, the blade has a nylon or the like plastic body including end columns 11, 12 and a runner 13 firmly embedded in the plastic body. It will be observed from FIG. 1 that the runner of the above type of skate blade is relatively low and smoothly merges with the relatively bulky, convexly rounded outer surface of the respective columns 11, 12.

The runner 13 of the skate has a generally straight, central portion 14 and rounded end portions 15, 16.

FIG. 2 shows a first half 17 and a second half 18 of the scabbard according to the present invention. Each of the two halves 17, 18 is preferably made by molding from a suitable rubber or plastics material, for instance nylon. The first half 17 has two side walls 19, 20 defining an elongated channel 21 therebetween. The channel 21 is generally continuous throughout the first end 22, wherein the body of the first half broadens to define a concavely curved wide wall section 23 which, as best shown in FIG. 1, is shaped to receive a portion of the front column 12 of a skate blade. It will be observed that the radius of curvature of the wide wall section 23 is considerably greater than the width of channel 21, the channel 21 being of generally the same width along its entire length from the aforesaid first end 22 throughout the straight, second end portion 28.

Extending transversely between the side walls 19, 20, is a plurality of upwardly convexly curved bottom wall members 24, each of the members 24 being integral with both respective side walls 20, 19. Two adjacent members 24 define between themselves a drainage passage or opening 25 widening in cross-sectional configuration in the direction downwardly away from the channel 21, as best seen on comparison of the cross-sectional portion of FIG. 1 and FIG. 4. Accordingly, the row of bottom wall members 24 provides, at the top, convexly rounded portions thereof, an interrupted support surface for the runner 13 of the skate blade, while two longitudinally adjacent members 24, 24, in cooperation with the side walls 19, 20, define a plurality of drainage openings 25 each widening in the direction away from the channel 21.

A plurality of transverse openings 26 extends through each of the bottom wall members 24, the size of each opening 26 being such as to receive a pin 27 of a spring assembly that will be referred to hereinafter.

A longitudinal passage 29 of a horizontally elongated, rectangular cross-sectional configuration extends throughout generally the entire straight portion of the first half 17, as best seen in FIG. 1 but also in FIG. 3.

Turning now to the second half 18, it will be seen that its general configuration is identical with that of the first half 17 with the only exception of a tongue 30 of horizontally elongated rectangular cross-section, the size of the tongue 30 being selected such that it can freely slide within the passage 29 of the first half 17. The remaining portions of the second half 18 are generally identical with those described in connection with the first half 17. Such identical portions therefore are not referred to in detail. It will suffice to say that the second half 18 also has a first end portion 31 turned upwardly and backwards and a second generally straight end portion 32 as shown in FIGS. 1 and 2. The respective second end portions 32 and 28 are in an aligned relationship due to the engagement between the passage 29 and tongue 30, the two forming slide means maintaining the respective second end portions 32 and 28 aligned at all times. Disposed in the transverse opening 26 coincident with the second end portion 28 of the first half 17 is the aforesaid pin 27. A similar pin 33 is disposed in the corresponding one of transverse opening 33*a* (FIG. 2) of the second half 18. The respective ends of pins 27, 33 are connected to a pair of tension springs 34, 35 maintaining the two halves 17, 18, in assembled relationship and assisting in firmly securing same to the skate runner 14 by pulling the two halves together, thus engaging the respective second end portions 22, 31 with the respective ends 15, 16 of runner 14. When the scabbard is used with the TUUK (Trademark) blade, the respective wide wall sections 23 of each of the halves 17, 18, engage the respective end columns 12, 11 of the blade, while the runner blade 14 is received within the narrow channel 21.

FIG. 1 shows that the portion of tongue 30 spanning the space between the second end portions 28, 32 of the first and second halves 17, 18, is disposed below the central portion 14 of the runner 13, whereby the normally sharp runner is protected regardless of the actual spacing between the respective second portions 28, 32.

Due to the combination of a narrow channel 21 and the wide wall section 23, the scabbard can be used with virtually any type of skate blade including the most recently introduced TUUK (Trademark) blades. It will be appreciated that it is not vital that the scabbard engage a blade by the wide wall section 23, if the channels 21 of the respective halves 17, 18 are engaged with the front and back end of the runner of e.g. a figure skating blade.

The drainage openings 25 provide further advantage in allowing drainage of water from ice that may have accumulated on the blade during the skating. The gradual broadening of the passages facilitates passage through the drainage openings of debris and also assists in preventing the accumulation of ice in the respective openings 25. Turning now to the representations of FIGS. 6–9, a particularly preferred embodiment of the invention will be described. In this embodiment, there are again two generally identical halves 40, 41 which are maintained in alignment by means substantially different from those shown in the first embodiment. The halves, 40, 41 are identical with each other and therefore, the respective parts thereof as referred to hereinafter will be designated with the same reference numeral. Each of the halves has a normally horizontal channel 42, for receiving the runner of the skate. As in the first embodiment, each respective channel merges at a first end 43 of the respective half with an upwardly turned first end portion. The respective second end portion 44 is generally straight and forms a step-on outer surface 45 (FIG. 8).

Figure 9:
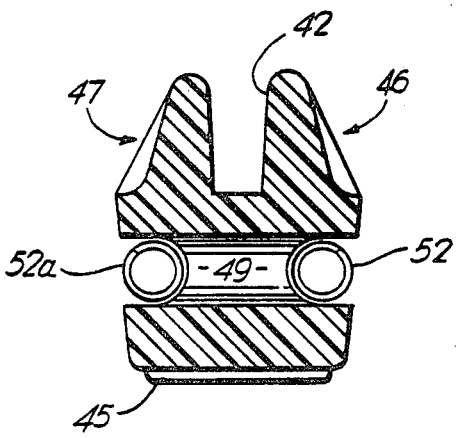
FIG. 9 is section IX—IX of FIG. 7.
Figure 8:
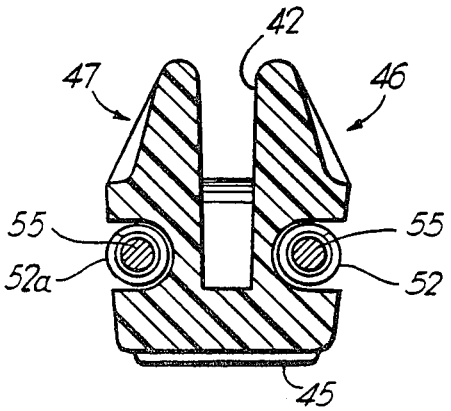
FIG. 8 is section VIII—VIII of FIG. 7.

Two exterior side walls 46, 47 extend generally upwardly from the step-on surface 45 as best shown in FIGS. 8 and 9.

Each side wall portion defines an elongate channel-shaped groove 48 which extends a substantial portion of the respective half, and when the two halves are aligned forms, with the corresponding groove 48 of the other half, a coaxial, elongate channel. In the bottom of the groove 48 is a plurality of transverse openings 49. A selected pair of openings, one in each half, receives a transverse anchor pin 50, 51 to which is attached a respective end of a tension spring 52, 52*a*, respectively. The anchor pins 50, 51, therefore can also be referred to as a first and second anchor point, respectively. They are generally equidistantly spaced from the respective face wall 53. The face walls 53 of the two halves 40, 41 combine with the scabbard removed from the skate, to form an abutment joinder 54 (FIG. 7) which, in a preferred embodiment, is thus equidistantly spaced from both anchor points 50, 51.

As best seen from FIGS. 8 and 9, the width and depth of the side channels 48 is sufficient to generally completely house the respective spring 52, 52*a*.

Figure 7:
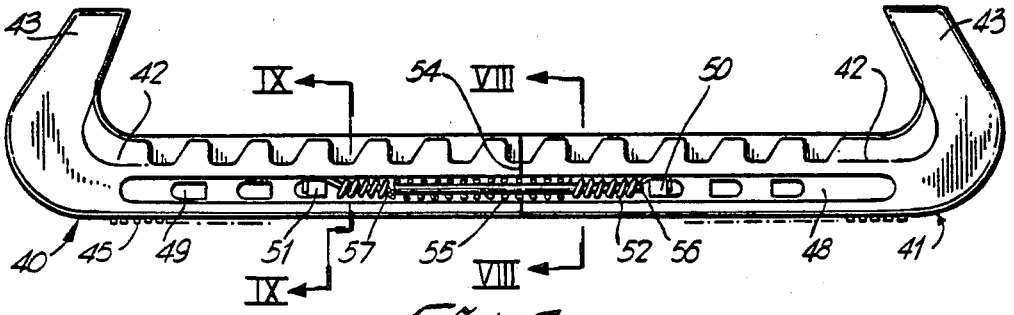
FIG. 7 is a side view of the scabbard of FIG. 6, showing the state thereof when the scabbard is removed from the skate or is about to be applied to a skate, the elements of same cooperating to maintain the two halves thereof in an aligned state.

Within each spring 52, 52*a* is slidably received an elongate pin 55. In the preferred embodiment, the pin 55 is freely received within the convolutes of the respective spring 52, 52*a*. In the arrangement of FIG. 7, it can be seen that one end 56 of the pin 55 is adjacent the anchor point 50, while the other end 57 is relatively remote from the opposite anchor point 51. The overall length of the pin 55, as measured from 56 to 57, however, is in excess of the distance from any of the anchor points 50, 51 to the respective face wall 53 so that the pin 55 bridges the joinder 54 at all times.

Due to the arrangement of the pin being shorter than the overall distance between the anchor points 50, 51 in an abutted state shown in FIG. 7, the scabbard can be folded by placing one half over the other, since a forced folding will displace the springs 52, 52*a* from the respective grooves and at least a part of the length of each spring will remain resilient and allow bending of the spring thus making it possible to fold the two halves if desired.

Those skilled in the art will readily appreciate further embodiments of the present invention departing, to a greater or lesser degree, from the embodiments shown in the drawing. For instance, the second half 18 shown in the present drawing is indicated as an integral molded piece. It will be appreciated, however, that the half 18 can also be produced by making the portion 18 entirely identical with that of the half 17, whereupon a separate tongue 30 may be inserted into a portion of the passage 29 and, for instance, adhesively secured to same. Similarly, several items referred to above need not necessarily be included in a commercial product even though they are believed to be of advantage. For instance, the drainage openings 25 need not necessarily be outwardly flared as shown. As a matter of fact, many scabbard manufacturers may prefer to make the scabbard without any passages or openings in the bottom wall of the channel. Similarly, the actual arrangement of sliding means constituted by the passage 29 and the tongue 30 can have a wide variety of further embodiments differing from the rectangular tongue and passage as shown. For instance, two cylindric protrusions with corresponding passages of circular cross-section are readily conceivable and would operate in generally the same manner. Nor is it necessary to locate the pin 27, 33 in the terminal openings 27, 33*a,* respectively, as it may be desirable to select a different combination of the pair of openings 27, 33*a,* without encountering undue difficulties as the openings are all of generally the same size.

It will be also appreciated that many modifications of the second, particularly preferred embodiment are possible without departing from the scope of the present invention as set forth in the accompanying claims.

I claim:

1. An ice skate scabbard comprising, in combination:

(a) two generally identical halves arranged for engaging respective ends of an ice skate blade to provide protective cover of both said ends and of a substantial portion of the runner part thereof;

(b) each of said halves comprising longitudinal, normally horizontal channel means for receiving said runner part, each respective channel means merging at a first end of the respective half with an upwardly turned first end portion, a second end portion of each half being generally straight, each second end portion having a step-on outer surface and two exterior side walls, and a face wall facing away from the respective first end and adapted to abut against the face wall of the other half, each side wall having an elongate groove-like depression extending generally parallel with said step-on surface;

(c) a pair of generally identical tension springs, each anchored, at a first anchor point, to one of said halves, and, at a second anchor point, to the other one of said halves;

(d) said anchor points being each generally coincident with the respective groove-like depression, and being spaced from the respective face wall;

(e) said springs being each coextensive with and received in the respective groove-like depressions of the two halves at the respective sides of the scabbard;

(f) said springs being under tension when said face walls abut against each other, whereby the face walls abutting against each other, the grooves, and the springs co-operate to maintain alignment of the two halves.

2. A scabbard as claimed in claim 1, wherein an elongated pin is disposed within each of said tension springs, the length of each pin being in excess of the distance between each respective anchor point and the respective face wall, whereby the pin bridges, on abutment of said face walls, a joinder of the two halves at the face walls.

3. A scabbard as claimed in claim 2, wherein the anchor points are each equidistantly spaced from the respective face wall.

4. A scabbard as claimed in claim 2 or 3, wherein the pin is a cylindric pin loosely received within the respective tension opening.

5. A scabbard as claimed in claims 1, 2 or 3, wherein the springs are each helical springs and wherein the groove-like depressions are each a channel whose width and depth generally corresponds to the outer diameter of the spring.

6. An ice skate scabbard comprising two generally identical halves arranged for engaging respective ends of an ice skate blade to provide protective cover of both said ends of the blade and of a substantial portion of the runner part thereof; spring means including a pair of tension springs each mounted at one side of the scabbard exteriorly thereof for resiliently urging said two halves to each other, each of said halves comprising longitudinal, normally horizontal channel means for receiving said runner part, each respective channel means merging at a first end of the respective half with an upwardly turned first end portion, the second end portion of each half being generally straight and having a step-on outer surface, and including means for securing the respective end of each of said tension springs to the respective second end portion, and sliding guide means for maintaining the respective second end portions in an aligned position while allowing relative movement therebetween in longitudinal direction, the upwardly turned first end portion being formed by a relatively wide wall section of a concavely curved cross-sectional configuration of a relatively great radius, said relatively wide wall section having a relatively narrow groove of a generally rectangular cross-section extending longitudinally and centrally of said relatively wide wall section, whereby the scabbard is suitable for use with virtually any kind of skate blade.

7. A scabbard as claimed in claim 6, wherein the guide means is formed by a tongue of a generally rectangular cross-sectional configuration, the tongue projecting longitudinally from the second end portion of one of said halves, and by a longitudinal passage provided in the second end portion of the other half, for slidably receiving said tongue, the respective end of each of said tension springs being secured to the second end of said one of said halves remote from the tongue, whereby the tongue is free of tension forces generated by said spring means.

8. A scabbard as claimed in claim 6, wherein the channel means is of the type defined by two generally parallel side walls and by an upper surface of bottom wall means whose exterior forms said step-on surface, said bottom wall means being provided with a plurality of drainage passages extending through said bottom wall means to thus communicate said channel means with the exterior of said bottom wall means, the cross-sectional area of said passages gradually increasing in the direction away from said upper surface of the bottom wall means.

* * * * *